United States Patent [19]

Rohner et al.

[11] 4,452,035

[45] Jun. 5, 1984

[54] THREAD SPLICING DEVICE

[75] Inventors: Joachim Rohner; Heinz Zumfeld; Reinhard Mauries, all of Monchen-Gladbach; Hans-Jürgen Preuhs, Willich, all of Fed. Rep. of Germany

[73] Assignee: W. Schlafhorst & Co., Monchen-Gladbach, Fed. Rep. of Germany

[21] Appl. No.: 315,309

[22] Filed: Oct. 27, 1981

[30] Foreign Application Priority Data

Oct. 29, 1980 [DE] Fed. Rep. of Germany ..... 3040661

[51] Int. Cl.[3] ..... B65H 69/06; D01H 15/00; D02J 1/08

[52] U.S. Cl. ..... 57/22; 28/274

[58] Field of Search ..... 57/22, 23, 333, 350; 28/271–276

[56] References Cited

U.S. PATENT DOCUMENTS 3,306,020 2/1967 Rosenstein ..... 57/22
3,345,809 10/1967 Gemeinhardt et al. ..... 57/22
3,407,583 10/1968 Irwin et al. ..... 57/22
3,477,217 11/1969 Bell et al. ..... 57/22
3,648,336 3/1972 Bevington, Jr. ..... 57/22 X
4,002,012 1/1977 Norris et al. ..... 57/22

*Primary Examiner*—John Petrakes
*Attorney, Agent, or Firm*—Herbert L. Lerner; Laurence A. Greenberg

[57] ABSTRACT

Thread splicing device, including a stationary base body having a first compressed-air canal formed therein, a splicing head being interchangeably connected to the base body, the splicing head having a second compressed-air canal formed therein being in communication with the first compressed-air canal formed in the base body, the splicing head having a plurality of air discharge nozzles formed therein being in communication with the second compressed-air canal formed in the splicing head, and the splicing head having a splicing chamber formed therein being in communication with the air discharge nozzles formed in the splicing head, the splicing chamber including a selectively coverable longitudinal slot for inserting and joining threads.

28 Claims, 18 Drawing Figures

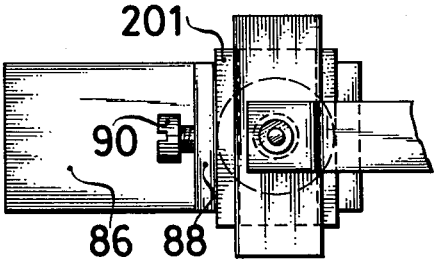
FIG. 2
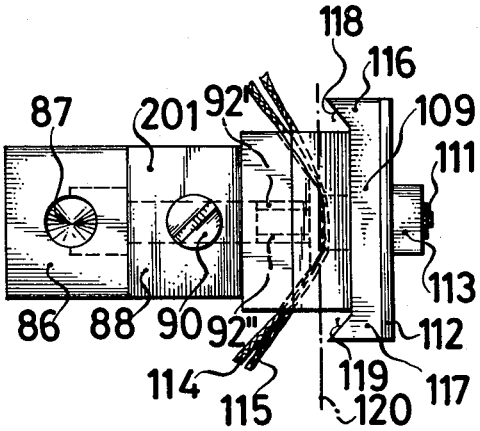
FIG. 3
FIG. 1
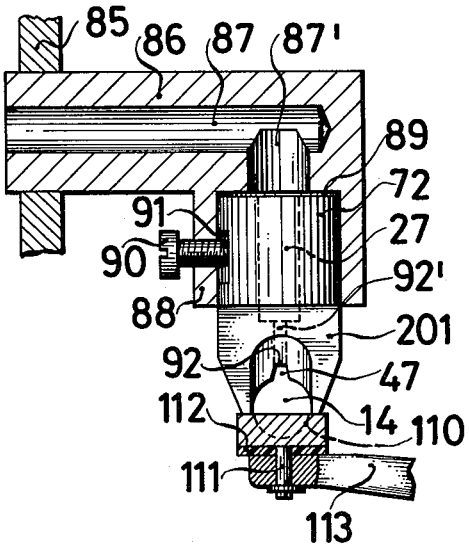

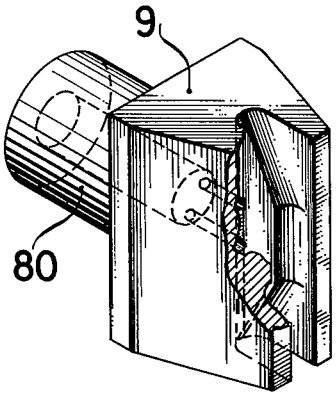
FIG. 4
FIG. 6
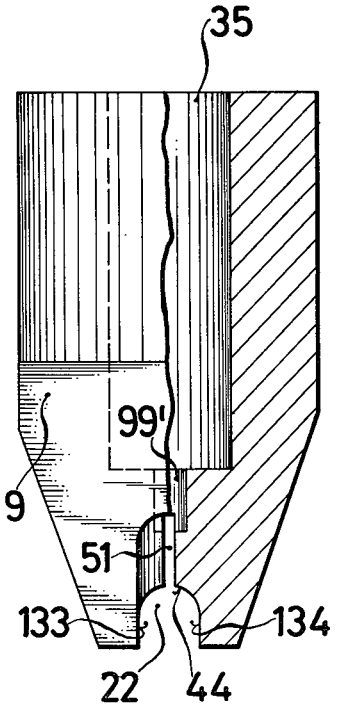
FIG. 5
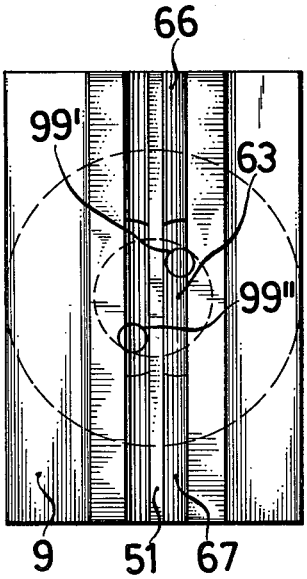

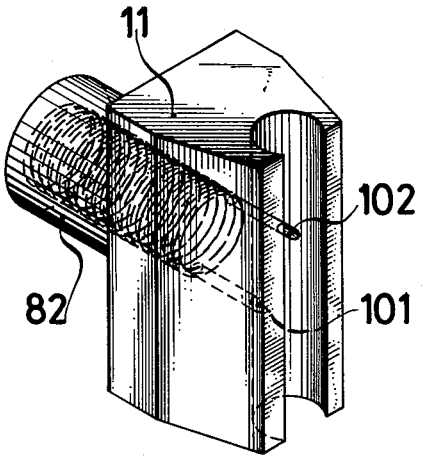
FIG.7
FIG.9
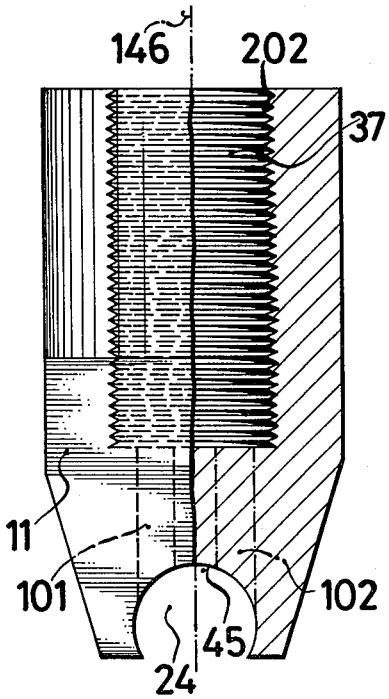
FIG.8
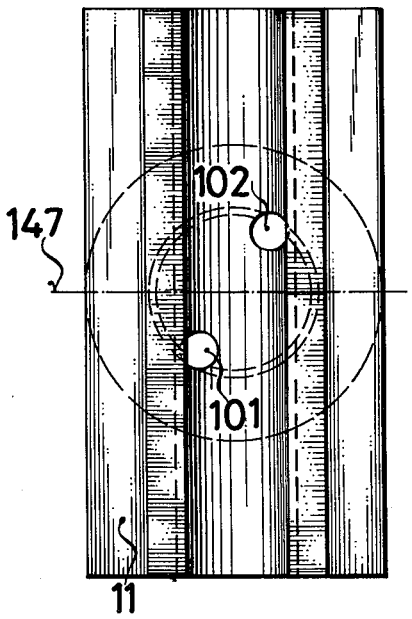

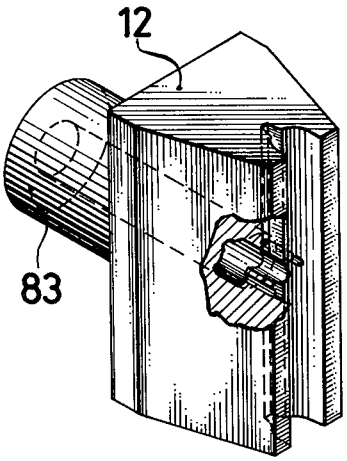
FIG. 10
FIG. 12
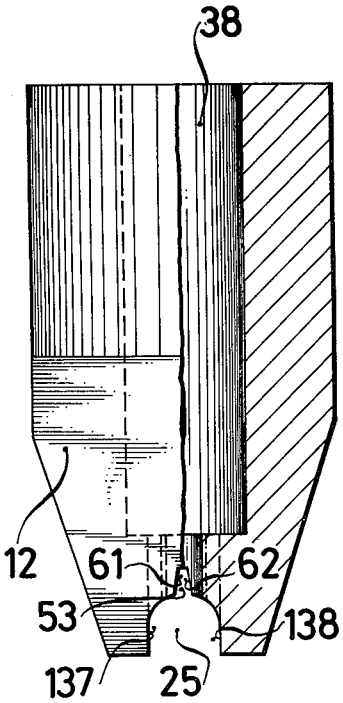
FIG. 11
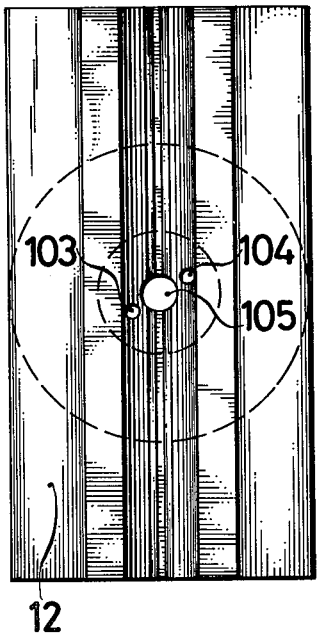

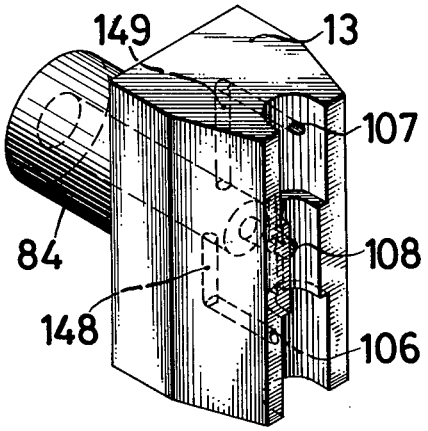
FIG. 13
FIG.15
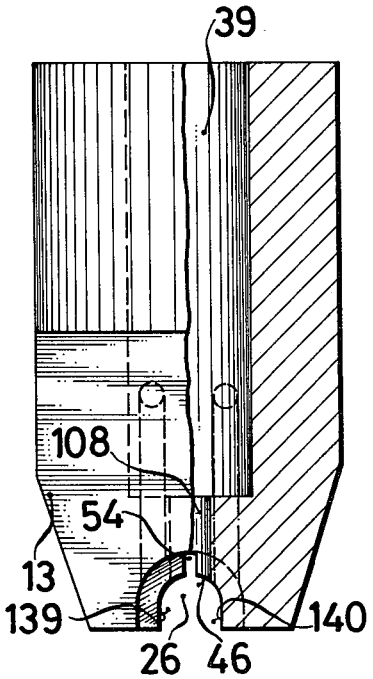
FIG.14
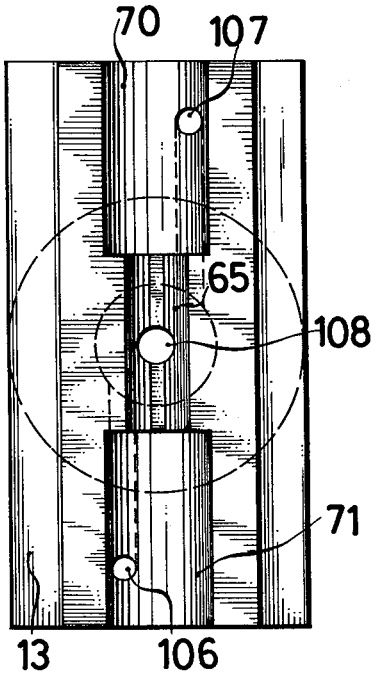

THREAD SPLICING DEVICE

The invention relates to a thread splicing device with a splicing head, which has a splicing chamber with an optionally coverable longitudinal slot formed therein for inserting and joining the threads, a compressed-air canal opening into the splicing chamber, and an optional cover for temporarily covering the longitudinal slot.

Since the possible uses of the known thread splicing devices are limited, and since one and the same splicing head cannot be used very well for different threads and yarns, such as long staple yarns, short staple yarns, and for different yarn thicknesses and different yarn twists, it has already been proposed in co-pending U.S. Patent Application Ser. No. 225,636, filed Jan. 16, 1981, now abandoned, to provide a stationary base body with a compressed-air-carrying canal, and to connect the splicing head to the base body so that it is readily interchangeable. It was left open in that publication as to what the details of the nature and the construction of the splicing head must be in order to produce an effective splicing operation of different yarns, twines and threads.

It is accordingly an object of the invention to provide a thread splicing device which overcomes the hereinafore-mentioned disadvantages of the heretofore-known devices of this general type, and in which the splicing heads thereof are not only easily interchangeable but each one of the individual splicing heads is already adjusted for the effective splicing of given yarns, twines and threads.

The basic idea of the invention to see to it that the shape, cross section, arrangement, and covering of the longitudinal slot are in harmony with a construction of the compressed-air entrance, and that the shape, cross section, location, orientation, mouth, and the ratio of the cross section of the longitudinal slot to the cross section of the mouth of the compressed-air canal opening into the longitudinal slot, are matched to the diameter, cross section, volume, number, twist, type of fiber, fiber length, fiber structure, surface structure of the fibers, surface roughness of the fibers, staple length, surface structure of the thread, roughness of the thread and/or the moisture content, degree of electrostatic charging, size content, and foreign body content of the threads to be joined together, in an optimum manner.

With the foregoing and other objects in view there is provided, in accordance with the invention, a thread splicing device, comprising a stationary base body having a first compressed-air-carrying canal formed therein, a splicing head being readily interchangeably connected to the base body, the splicing head having a second compressed-air canal formed therein being in communication with the first compressed-air canal formed in the base body, the splicing head having a plurality of air discharge nozzles formed therein being in communication with the second compressed-air canal formed in the splicing head, and the splicing head having a splicing chamber formed therein being in communication with the air discharge nozzles formed in the splicing head, so that the nozzles open into the chamber, the splicing chamber including a selectively coverable longitudinal slot for inserting and joining threads. In accordance with another feature of the invention, there is provided a cover for temporarily covering the longitudinal slot. This proposal opens up many possibilities for optimum splicing. Firstly, individual splicing joints can be brought about by air discharge nozzles distributed along the longitudinal slot at a greater or lesser distance from each other. Secondly, in the case of heavily twisted yarns, the yarn twist can be opened up more advantageously by corresponding air swirls, if in accordance with a further feature of the invention, the air discharge nozzles are formed on two sides, such as the right and left, of a plane of symmetry passing lengthwise through the longitudinal slot. The compressed-air canal may be connected, for instance, to two air discharge nozzles, of which the one is arranged to the left and the other to the right of the symmetry planes going through the length of the slot.

The air discharge nozzles may be disposed directly opposite each other. For splicing heavily twisted yarns, however, it is better if in accordance with an added feature of the invention, the air discharge nozzles are formed on two sides, such as the right and left, of a plane of symmetry passing transversely through the longitudinal slot. If there are two air discharge nozzles, for instance, then one can be arranged to the left and the other to the right of the symmetry plane going transversely through the length of the slot.

In accordance with an additional feature of the invention, the air discharge nozzles are formed at the intersection of the planes of symmetry. Such an arrangement has, in particular, the advantage of assuring that one air jet flows into the splicing chamber or into the longitudinal slot, which does not generate a rotating air swirl but penetrates centrally into the threads to be spliced. The other air discharge nozzles may be located in such a way that air swirls are formed. If, for instance, three air discharge nozzles are provided, then one air discharge nozzle is disposed at the intersection of the symmetry planes in accordance with the last-mentioned feature, while the disposition of the other two air discharge nozzles is left open to choice. The nozzles are then either accomodated in the middle section also, or advantageously in the end sections of the longitudinal slot.

In accordance with again another feature of the invention, the central axes of the air discharge nozzles are disposed parallel to the intersection line of the planes of symmetry.

The ratio of the cross section of the longitudinal slot to the total cross section of the air discharge nozzles has a great influence on the effectiveness and the optimal success of the splicing and on the quality of the spliced joint. To this end it is proposed in a further embodiment of the invention that the ratio of the cross section of the longitudinal slot to the total cross section of the air discharge nozzles is in three selected ranges.

In accordance with again a further feature of the invention, the ratio of the cross section of the longitudinal slot to the combined cross section of the air discharge nozzles is between 1.4 and 3.0.

In accordance with again an added feature of the invention, the ratio of the cross section of the longitudinal slot to the combined cross section of the air discharge nozzles is between 3.7 and 4.0.

In accordance with again an additional feature of the invention, the ratio of the cross section of the longitudinal slot to the combined cross section of the air discharge nozzles is between 7.0 and 9.0.

The first mentioned range is advantageous for bulky threads, wool threads, rug yarns and the like. The middle range from 3.7 to 4.0 is particularly suitable for simple yarns and mixed wool yarns; and the range from 7.0 to 9.0 is particularly suitable for splicing cotton yarns and heavily twisted yarns particularly in connection with a formation of the air discharge nozzles such that a rotary flow is generated.

In specially situated cases, however, it may also be advantageous to choose ratio ranges which are next to, or between, the mentioned ranges.

In accordance with yet another feature of the invention, the second compressed-air canal has a larger open cross section than the air discharge nozzles combined. In accordance with yet a further feature of the invention, the air discharge nozzles have a different cross-sectional shape than the second compressed-air canal. These features may also be combined. Thus, a discontinuity is provided in every case in the air discharge nozzles, which advantageously triggers air turbulence. If the free or open cross section of the air discharge nozzle is smaller than the free or available cross section of the compressed-air canal, then the pressure drop of the compressed-air canal is not as noticeable during the splicing.

In order to make sure that the clusters of air jets emerging from the air discharge nozzles do not have a mutual adverse effect, in accordance with yet an added feature of the invention, the central axes of the air discharge nozzles are disposed parallel to the intersection line of the planes of symmetry, as mentioned above.

It has already been mentioned above that a turbulent flow has advantages for splicing. In accordance with yet an additional feature of the invention, there is provided a turbulence generator at least partly disposed in the second compressed-air canal. In accordance with still a further feature of the invention, the turbulence generator is in the form of an obstacle extended transversely through the second compressed-air canal. Such an obstacle is easy to make and install. This may be a plug-in pin or a canal insert. In accordance with another feature of the invention, the splicing head has a wall of the second compressed-air canal formed thereon, and the turbulence generator is in the form of macroscopic irregularities of the wall. According to experience, wall irregularities smaller than macroscopic do not lead to sufficient turbulence. In accordance with a further feature of the invention, the wall irregularities are in the form of a screw thread formed in the wall of the second compressed-air canal. Since the compressed-air canal usually has a circular cross section, such a screw thread is easy to form. Through the choice of the pitch and depth of the thread, the effectiveness of the wall irregularities can easily be varied.

Advantageously, the splicing head has a plug-in base which protrudes into the base body and through which the compressed-air canal is brought. This offers various advantages. Firstly, a seal between the base body and the splicing head can be accomplished in this way without special sealing means because of the labyrinth effect; and secondly, the splicing head is given a firm hold in the base body. Thirdly, the plug-in base simultaneously serves as a wall of the compressed-air canal.

In order to prevent the splicing head from turning and to allow the splicing head to be connected quickly and securely to the base body, while at the same time retaining easy interchangeability, the plug-in base has a cylindrical outer surface with a flat, and the base body has a holding element directed toward the flat. Such holding element may, for instance, be a fastening screw, the end of which is aimed at the flat of the plug-in base. Other holding elements can also be used, such as indexing pins with spring loading, latches operated by hand with spring loading or the like.

In accordance with an added feature of the invention, the splicing head has a bottom of the longitudinal slot formed thereon and a substantially V or U-shaped groove formed in the slot bottom extended along the longitudinal slot, at least one of the air discharge nozzles being open into the groove. This groove has two purposes. For one thing, it can be made so wide that it initially accepts the threads to be spliced. It is then ensured that the threads will lie close together prior to the splicing operation proper. However, the groove can also serve the purpose of better distributing the splicing air and of accelerating the threads to be spliced toward the cover. In order to fulfill this task, it is proposed in a further embodiment of the invention that the compressed-air discharge is in the groove.

Effective optimal splicing, i.e. good mixing of the fibers, is obtained if in accordance with an additional feature of the invention, the splicing head has lateral boundaries of the groove formed thereon being disposed at an angle of substantially 30° to each other. The compressed air emerging at the bottom of the groove has an optimum fan effect with this construction of the lateral boundaries, and the threads to be inserted are brought into good contact with each other through the inclined position of the lateral boundaries.

In accordance with again another feature of the invention, the splicing head has sections of the longitudinal slot formed therein, including end sections of relatively larger cross section and a middle section of relatively small cross section, the air discharge nozzle being distributed over at least one of the middle and/or end sections. A splicing head constructed in this manner is suitable for splicing thin threads as well as thick threads. When inserted, the threads lie close together in the middle section. In general, the air is also supplied there. The length of the middle section again depends on the specifications of the threads.

In accordance with again a further feature of the invention, the cross section of the longitudinal slot changes relatively abruptly or gradually between the middle section and the end sections. Both have advantages for certain threads. For coarse threads, a gradual change of cross section is preferred. For finer yarns, a sudden cross sectional change may be advantageous, especially if in accordance with again an added feature of the invention, the relatively larger cross section of the end sections is extended toward the sides. In this case, the narrowly confined part itself of the bottom of the slot, on which the threads lie, is not included in the enlargement of the cross section. If coarser yarns are spliced, on the other hand, it is of advantage if in accordance with again an added feature of the invention, the splicing head has a bottom of the longitudinal slot formed thereon, and the relatively larger cross section of the end sections is extended toward or from the bottom of the longitudinal slot.

An enlarged cross section of the end sections of the longitudinal slots can also be obtained by rounding the edges of the longitudinal slot. Since rounding the edges also facilitates the insertion of the threads and avoids damage, in accordance with again an additional feature of the invention, the splicing head has rounded and smoothed edges of the longitudinal slot formed thereon. All edges of the longitudinal slots are to be included.

In accordance with yet another feature of the invention, there is provided means disposed at ends of the longitudinal slot for selectively guiding thread and/or air. These thread-guiding means and/or air-guiding means fulfill a dual purpose. Primarily, the air is to be discharged and dosed from the splicing chamber. Secondarily, these means also serve for the correct insertion of the threads and the guiding of the threads during the splicing operation. In accordance with a concomitant feature of the invention, the guiding means are in the form of thread and air guiding metal plates or surfaces partially closing off ends of the longitudinal slot.

All in all, the invention provides an expert with the means necessary to construct the splicing head in such a way that overall, it is optimally adapted to the diameter, cross section, volume, number, twist, type of fiber, fiber length, fiber structure, surface structure of the fibers, surface roughness of the fibers, staple length, surface structure of the thread, roughness of the thread and/or moisture content, degree of electrostatic charging, sizing content, and content of foreign bodies, of the threads to be joined together.

Other features which are considered as characteristic for the invention are set forth in the appended claims.

Although the invention is illustrated and described herein as embodied in a thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, cross-sectional view of a first embodiment of a splicing device according to the invention;

FIG. 2 is a fragmentary bottom plan view of FIG. 1;

FIG. 3 is a side elevational view of FIG. 1;

FIG. 4 is a perspective view, partly broken away, of a second embodiment of the splicing head of the invention;

FIG. 5 is a front elevational view of FIG. 4;

FIG. 6 is a top plan view of FIG. 4, the part thereof to the right of the center line being partly broken away; and FIGS. 7–18 are respective perspective, front elevational, and top plan views of third through sixth embodiments of the splicing head of the invention, similar to FIGS. 4, 5 and 6.

Figure 16:
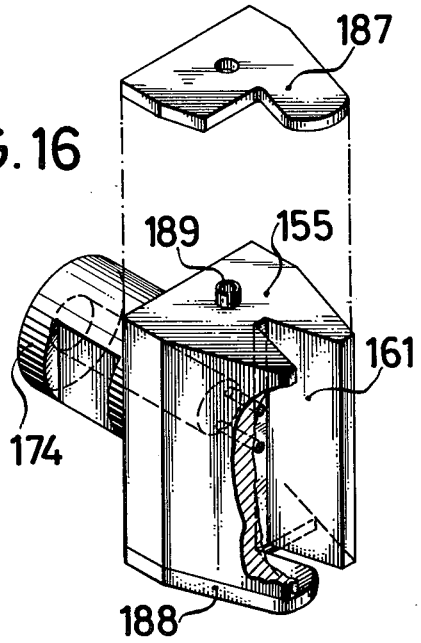

Referring now to the figures of the drawing and first particularly to the first embodiment of FIGS. 1–3 thereof, there is seen a frame 85 which carries a base body 86 of the thread splicing device, which is shown only with its essential details. The base body 86 has an angled-off compressed air-carrying canal 87, 87'. The base body 86 furthermore has a holding device for a splicing head 201, including an eye 88 having a receiving bore hole 89 formed therein and a holding element in the form of a fastening screw 90. The counterpart of this holding device is provided at the splicing head 201 in the form of a cylindrical plug-in base 72 which has a flat 91, against which the holding element 90 is directed.

The splicing head 201 has a splicing chamber, including a longitudinal slot 14. A compressed-air canal 27 leads through the plug-in base 72 to the vicinity of the longitudinal slot 14, where it ends at two air discharge nozzles 92', 92''. The air discharge nozzles have a smaller combined free or open available cross section than the cylindrical compressed-air canal 27.

The splicing head 201 can be covered by a pivotable cover 109. The cover 109 has a smooth surface facing the longitudinal slot 14. However, the cover 109 can also be optionally provided with a longitudinal slot 110, which better fits the cross-sectional shape of the longitudinal slot 14 of the splicing head 201. By means of a holding device 111, the cover 109 is fastened to a cover holder 113 with the interposition of a resilient plastic plate 112.

In particular, it is seen in FIG. 3 that the cover 109, which temporarily covers the longitudinal slot 14 during the splicing of the threads 114, 115 extends beyond the splicing head 201 in the direction of the longitudinal slot 14 and has thread hold-down devices 116, 117 at its ends. The thread hold-down device 116 has an air-guiding surface 118, and the thread hold-down device 117 has an air-guiding surface 119. The air-guiding surfaces are disposed at an angle to the travel direction 120 of the threads 114, 115, which is indicated by dot-dash lines.

In the second embodiment example of the invention shown in FIGS. 4, 5 and 6, there is seen a splicing head 9 with a plug-in base 80. In this embodiment the cross section of the longitudinal slot 22 is approximately semicircular at the bottom 44 of the slot and then merges into straight parallel boundaries 133, 134. The slot bottom 44 has an essentially U-shaped groove 51 formed therein which extends along the longitudinal slot 22.

According to FIG. 5, the longitudinal slot 22 is divided into three sections, a middle section 63 and two end sections 66, 67. The two end sections have a larger cross section than the middle section; the enlarged cross section of the end section 66, 67 extends with a gradual increase of the cross section from the slot bottom 44 toward the bottom of the groove 51 which is also reached by the two end sections at the very end.

The two air discharge nozzles 99' and 99'' extend from the compressed-air canal 35 to the groove 51. The groove 51 extends into the air discharge nozzles. Because of this construction, a slit-like cross-sectional shape of the air discharge nozzles is obtained, and the air can also emerge sideways.

In this embodiment example, the ratio of the slot cross section to the air discharge nozzle cross section, with respect to the middle section 63, is 3.0.

A third embodiment example of the invention is shown in FIGS. 7, 8 and 9 of the drawings. The splicing head 11 in this case has a plug-in base 82. The longitudinal slot 24 has a circular cross section but the circle is not complete. The symmetrical longitudinal slot 24 has two preferred symmetry planes 146, 147 which are perpendicular to each other.

In this embodiment example, two air discharge nozzles 101, 102 are provided. Both nozzles open into the slot bottom 45. In particular, FIG. 9 shows that the air discharge nozzle 101 is located to the left, and the air discharge nozzle 102 to the right, of the symmetry plane 146 going through the length of the slot 24. FIG. 8 of the drawing shows that the air discharge nozzle 101 is located below, and the air discharge nozzle 102 above, the symmetry plane 147 going through the longitudinal slot 24.

This special placement of the air discharge nozzles is particularly suitable for threads which have a Z-twist. If, on the other hand, with reference to the view of FIG. 8, the air discharge nozzle 102 is located at the top left and the air discharge nozzle 101 at the bottom right, then this placement is more suitable for threads with an S-twist.

The drawings show that the total cross section of the air discharge nozzles is substantially smaller than the free or available cross section of the compressed-air canal 37, which has a turbulence generator in the form of a screw thread 202.

A fourth embodiment of the invention is shown in FIGS. 10, 11 and 12 of the drawings. The splicing head 12 in this case has a plug-in base 83. The longitudinal slot 25 has an approximately semicircular cross section at the bottom of the slot which becomes parallel lateral sections 137, 138. The bottom of the slot has a groove 53 formed therein, which extends along the slot and has lateral boundaries 61, 62 which form an angle of about 30° with each other. The groove 53 does not extend in this embodiment into the compressed-air canal 38.

Three air discharge nozzles 103, 104 and 105 are provided. The air discharge nozzle 105 is centrally disposed and ends centrally in the groove 53. The nozzle 105 has a larger free or open cross section for compressed air than the two other air discharge nozzles 103 and 104, which are in a location similar to the preceding embodiment example.

The illustrated nozzle placement has the advantage that primarily, a centrally directed flow toward the threads to be spliced is applied, but in addition, limited rotary flows are also applied onto the threads and into the splicing chamber for aiding the central flow.

A fifth embodiment example of the invention is shown in FIGS. 13, 14 and 15. The splicing head 13 in the fifth embodiment has a plug-in base 84, through which a compressed-air canal 39 passes as in the other embodiment examples.

In this case the splicing head 13 has several peculiarities which together have the effect of allowing this splicing head to be somewhat more universally usable. The longitudinal slot 26 is approximately semicircular at the slot bottom 46 but then outwardly becomes short, straight, parallel, lateral boundaries 139, 140.

In this embodiment example, the longitudinal slot 26 is divided into three sections of approximately equal length, namely a middle section 65 and two end sections 70, 71. In the middle section 65 there is seen a groove 54 which starts from the slot bottom 46 and has a substantially U-shaped cross section. The cross-sectional shape of the end sections 70 and 71 otherwise resembles the cross-sectional shape of the middle section, with the exception that the end sections have no groove.

The cross section of the two end sections is larger than the cross section of the middle section. The cross-sectional change is abrupt. The enlarged cross section of the end section extends in this case to the sides of the longitudinal slot, as well as starting from the slot bottom of the longitudinal slot.

Three air discharge nozzles 106, 107 and 108 are provided. The air discharge nozzle 108 is disposed, as is easily seen, in the intersection line of the symmetry plane which goes lengthwise through the longitudinal slot, with the symmetry plane perpendicular thereto. The air discharge nozzle 106 is located in the end section 71 and the air discharge nozzle 107 is located in the end section 70, and more specifically to the left and to the right of the symmetry plane, respectively, possing lengthwise through the longitudinal slot.

The air discharge nozzle 108 opens centrally into the compressed-air canal 39. The air discharge nozzle 106 is connected by a small transversal canal 148 to the compressed-air canal 39, and the air discharge nozzle 107 is connected by a small transversal canal 149 to the compressed-air canal 39, as is shown in particular in FIG. 13.

The air discharge nozzle 108 is located in the longitudinal axis of the compressed-air canal 39. The central axes of the air discharge nozzles 106 and 107 are parallel to the central axis at the end of the compressed-air canal 39. In this embodiment example, the air discharge nozzles are considerably farther apart from each other than in the preceding embodiment example.

The splicing head 13 is particularly suitable for splicing thin, heavily twisted threads and for splicing threads of particular sensitivity. Its field of application, however, also extends toward coarser threads.

This embodiment example of the invention is again suitable especially for Z-twisted threads as well. For S-twisted threads, with reference to the view of FIG. 14, the air discharge nozzle 106 can be shifted to the right and the air discharge nozzle 107, to the left.

Figure 18:
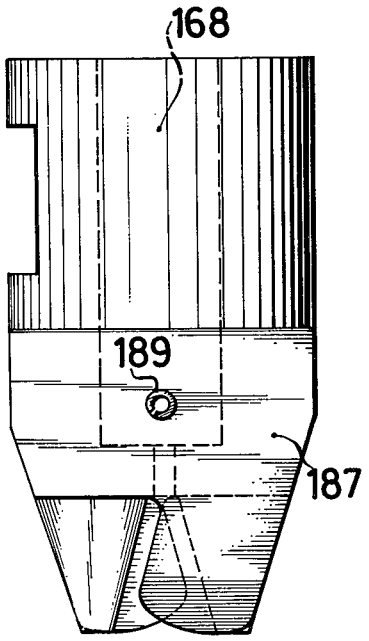
Figure 17:
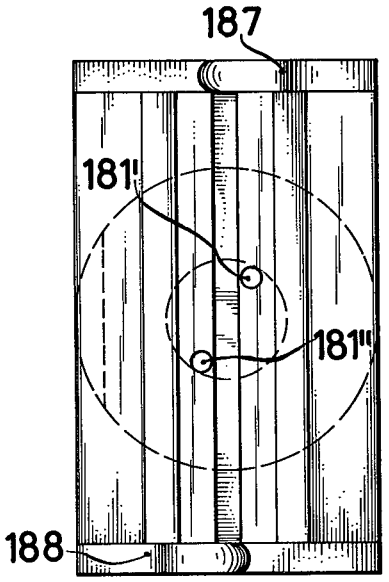

In the sixth embodiment example of the invention, according to FIGS. 16, 17 and 18 of the drawings, a splicing head 155 with a plug-in base 174 is seen. In this case too, the longitudinal slot 161 has a cross section in the form of a trapezoid, the shorter base of which forms the bottom of the slot. The compressed-air canal 168 ends at air discharge nozzles 181' and 181''.

At the ends of the longitudinal slot 161, there are disposed thread-guiding and air-guiding means in the form of thread and air-guiding metal plates 187, 188. The air-guiding metal plates are fastened by spring pins 189 to the end faces of the splicing head 155, and are thus adjustable as to their covering effect. It is seen in the drawings that the thread and air-guiding metal plates partially cover the longitudinal slot 161, but only far enough to ensure that the guidance of the threads is not impaired.

Bulky threads, hairy or bristly threads, electrostatically charged threads and particularly dry threads can be spliced well with the devices according to the third embodiment example. Fine threads, heavily twisted threads, sized threads or moist threads can be better spliced with devices according to the second, fourth and fifth embodiment examples. The devices according to the fifth and sixth embodiment examples can be used more universally for fine, thin threads as well as for bulky threads of cotton, wool or mixtures with synthetic fibers. In the sixth embodiment example, the adjustability of the thread and air-guiding metal plates 187, 188 is also advantageous.

In all embodiment examples, the edges of the longitudinal slot should be rounded and smoothed. This is emphasized in particular because it cannot be directly seen from the views of the drawings.

The invention is not limited to the embodiment examples shown and described. All features of the described and shown embodiment examples can be interchanged in place of each other as desired, and combined with each other.

There are claimed:

1. Thread splicing device, comprising a stationary base body having a first compressed-air canal formed therein, a splicing head being interchangeably connected to said base body, said splicing head having a second compressed-air canal formed therein being in communication with said first compressed-air canal formed in said base body, said splicing head having a plurality of air discharge nozzles formed therein being in communication with said second compressed-air canal formed in said splicing head, and said splicing head having a splicing chamber formed therein being in communication with said air discharge nozzles formed in said splicing head, said splicing chamber including a selectively coverable longitudinal slot for inserting and joining threads, at least one of said nozzles forming an air swirl in a given direction around the inserted threads, and at least another of said nozzles forming an air swirl in a direction opposite said given direction around the inserted threads.

2. Thread splicing device according to claim 1, including a cover for temporarily covering said longitudinal slot.

3. Thread splicing device according to claim 1, wherein said air discharge nozzles are formed on two sides of a plane of symmetry passing lengthwise through said longitudinal slot.

4. Thread splicing device according to claim 1, wherein said air discharge nozzles are formed on two sides of a plane of symmetry passing transversely through said longitudinal slot.

5. Thread splicing device according to claim 1, wherein said air discharge nozzles are formed at the intersection of planes of symmetry respectively passing lengthwise and transversely through said longitudinal slot.

6. Thread splicing device according to claim 5, wherein the central axes of said air discharge nozzles are disposed parallel to the intersection line of planes of symmetry respectively passing lengthwise and transversely through said longitudinal slot.

7. Thread splicing device according to claim 1, wherein said second compressed-air canal has a larger open cross section than said air discharge nozzles.

8. Thread splicing device according to claim 1, wherein said air discharge nozzles have a different cross-sectional shape than said second compressed-air canal.

9. Thread splicing device according to claim 1, including a turbulence generator at least partly disposed in said second compressed-air canal.

10. Thread splicing device according to claim 9, wherein said turbulence generator is in the form of an obstacle extended transversely through said second compressed-air canal.

11. Thread splicing device according to claim 9, wherein said splicing head has a wall of said second compressed-air canal formed thereon, and said turbulence generator is in the form of macroscopic irregularities of said wall.

12. Thread splicing device according to claim 11, wherein said wall irregularities are in the form of a screw thread formed in said wall of said second compressed-air canal.

13. Thread splicing device according to claim 1, wherein the ratio of the cross section of said longitudinal slot to the combined cross section of said air discharge nozzles is between 1.4 and 3.0.

14. Thread splicing device according to claim 1, wherein the ratio of the cross section of said longitudinal slot to the combined cross section of said air discharge nozzles is between 3.7 and 4.0.

15. Thread splicing device according to claim 1, wherein the ratio of the cross section of said longitudinal slot to the combined cross section of said air discharge nozzles is between 7.0 and 9.0.

16. Thread splicing device according to claim 1, wherein said splicing head has a bottom of said longitudinal slot formed thereon and a substantially V-shaped groove formed in said slot bottom extended along said longitudinal slot, at least one of said air discharge nozzles being open into said groove.

17. Thread splicing device according to claim 1, wherein said splicing head has a bottom of said longitudinal slot formed thereon and a substantially U-shaped groove formed in said slot bottom extended along said longitudinal slot, at least one of said air discharge nozzles being open into said groove.

18. Thread splicing device according to claim 16 or 17, wherein said splicing head has lateral boundaries of said groove formed thereon being disposed at an angle of substantially 30° to each other.

19. Thread splicing device according to claim 1, wherein said splicing head has sections of said longitudinal slot formed therein, including end sections of relatively larger cross section and a middle section of relatively smaller cross section, said air discharge nozzles being distributed over at least one of said sections.

20. Thread splicing device according to claim 19, wherein the cross section of said longitudinal slot changes relatively abruptly between said middle section and said end sections.

21. Thread splicing device according to claim 19, wherein the cross section of said longitudinal slot changes relatively gradually between said middle section and said end sections.

22. Thread splicing device according to claim 19, 20 or 21, wherein said relatively larger cross section of said end sections is extended toward the sides of said longitudinal slot.

23. Thread splicing device according to claim 19, 20 or 21, wherein said splicing head has a bottom of said longitudinal slot formed thereon, and said relatively larger cross section of said end sections is extended toward the bottom of said longitudinal slot.

24. Thread splicing device according to claim 19, 20 or 21, wherein said splicing head has a bottom of said longitudinal slot formed thereon, and said relatively larger cross section of said end sections is extended from the bottom of said longitudinal slot.

25. Thread splicing device according to claim 1, wherein said splicing head has rounded and smoothed edges of said longitudinal slot formed thereon.

26. Thread splicing device according to claim 1, including means disposed at ends of said longitudinal slot for selectively guiding thread and air.

27. Thread splicing device according to claim 26, wherein said guiding means are in the form of thread and air guiding metal plates partially closing off ends of said longitudinal slot.

28. Thread splicing device according to claim 1, wherein said splicing chamber is disposed along a substantially straight path with a substantially constant cross section.

* * * * *